US011119424B2

(12) United States Patent
Makita et al.

(10) Patent No.: US 11,119,424 B2
(45) Date of Patent: Sep. 14, 2021

(54) IMAGE FORMING UNIT AND IMAGE FORMING APPARATUS HAVING RESTRICTING PORTION TO PREVENT ROTATION

(71) Applicant: FUJIFILM Business Innovation Corp., Tokyo (JP)

(72) Inventors: Shota Makita, Kanagawa (JP); Takashi Akaike, Kanagawa (JP); Yosuke Kuwata, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/539,599

(22) Filed: Aug. 13, 2019

(65) Prior Publication Data

US 2020/0257219 A1 Aug. 13, 2020

(30) Foreign Application Priority Data

Feb. 12, 2019 (JP) ..... JP2019-022214

(51) Int. Cl.
*G03G 21/18* (2006.01)
*G03G 15/08* (2006.01)

(52) U.S. Cl.
CPC ..... *G03G 15/0874* (2013.01); *G03G 15/087* (2013.01); *G03G 15/0881* (2013.01); *G03G 21/181* (2013.01); *G03G 2215/0682* (2013.01); *G03G 2215/0875* (2013.01); *G03G 2221/1807* (2013.01)

(58) Field of Classification Search
CPC ..... G03G 15/0874; G03G 15/087; G03G 15/0881; G03G 2215/0682; G03G 2215/0875; G03G 21/181; G03G 2221/1807
See application file for complete search history.

(56) References Cited

U.S. PATENT DOCUMENTS 9,708,116 B2 * 7/2017 Koishi ..... G03G 15/0865
2005/0252815 A1 * 11/2005 Ahn ..... B65D 85/30 206/521
2006/0193654 A1 8/2006 Kamimura
2017/0285522 A1 * 10/2017 Martin ..... G03G 15/0874

FOREIGN PATENT DOCUMENTS

JP 2004205793 A * 7/2004
JP 2006-235525 A 9/2006

* cited by examiner

*Primary Examiner* — Walter L Lindsay, Jr.
*Assistant Examiner* — Laura Roth
(74) *Attorney, Agent, or Firm* — Sughrue Mion, PLLC

(57) ABSTRACT

Provided is an image forming unit contained in a flexible bag and held to allow a cushion member to absorb shock. The image forming unit includes: an image carrier on which an electrostatic latent image is formed; a developing device including a developing unit that is configured to develop the electrostatic latent image by turning around a turning center and coming into contact with the image carrier; and a developer accommodating portion that accommodates a developer for use in the developing device. The image forming unit also includes a restricting portion that is provided on an outermost portion of the developing device to come into contact with the cushion material so that rotation of the developing device is restricted.

9 Claims, 10 Drawing Sheets

IMAGE FORMING UNIT AND IMAGE FORMING APPARATUS HAVING RESTRICTING PORTION TO PREVENT ROTATION

CROSS-REFERENCE TO RELATED APPLICATIONS

This application is based on and claims priority under 35 USC 119 from Japanese Patent Application No. 2019-022214 filed Feb. 12, 2019.

BACKGROUND

(i) Technical Field

The present disclosure relates to an image forming unit and an image forming apparatus.

(ii) Related Art

There has been a packing method for a used process cartridge including at least a developer accommodation chamber provided with a developer extracting port for extracting a residual developer therefrom, a developer carrier, and a developing chamber disposed adjacent to the developer accommodation chamber and with the developer carrier disposed therein, the packing method including: packing the used developer cartridge with the developer carrier positioned vertically above the developer extracting port (JP-A-2006-235525).

SUMMARY

Aspects of non-limiting embodiments of the present disclosure relate to providing an image forming unit and an image forming apparatus, which allow a cushion member to absorb a fall-induced impact load applied to a developer accommodating portion, in contrast to a configuration not including a restricting portion disposed on an outermost portion of a developing device to come into contact with a packing material so that the rotation of the developing device is restricted.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming unit contained in a flexible bag and held to allow a cushion member to absorb shock, the image forming unit including: an image carrier on which an electrostatic latent image is formed; a developing device including a developing unit that is configured to develop the electrostatic latent image by turning around a turning center and coming into contact with the image carrier; a developer accommodating portion that accommodates a developer for use in the developing device; and a restricting portion that is provided on an outermost portion of the developing device to come into contact with the cushion material so that rotation of the developing device is restricted.

BRIEF DESCRIPTION OF THE DRAWINGS

Exemplary embodiments of the present invention will be described in detail based on the following figures, wherein.

DETAILED DESCRIPTION

Figure 1:
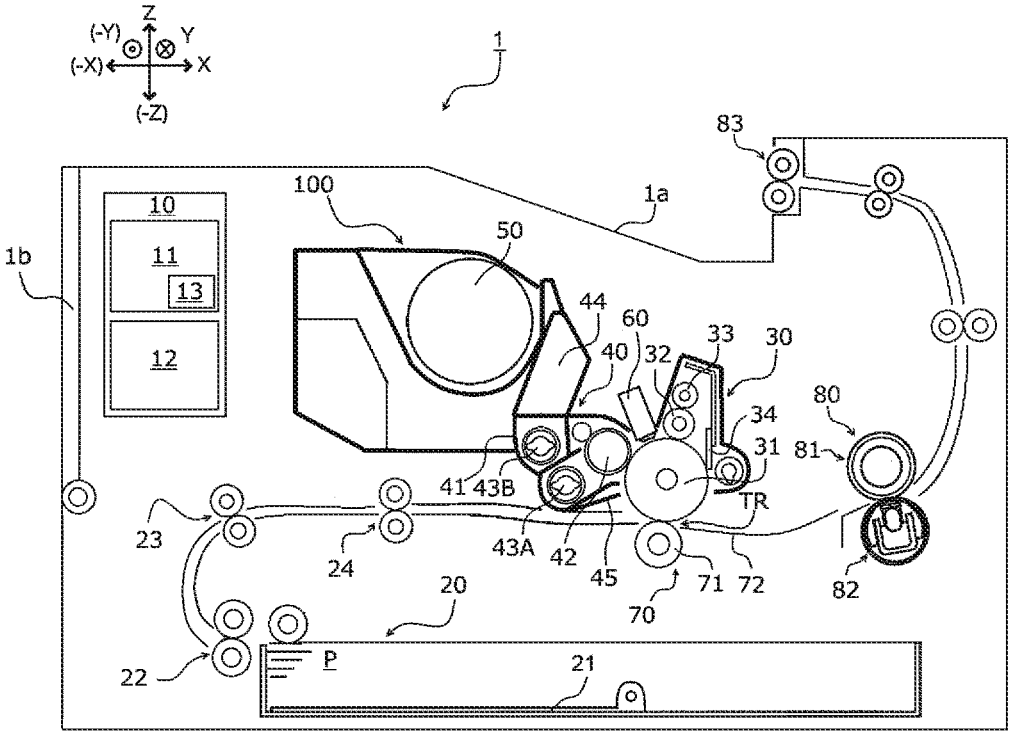
FIG. 1 is a schematic longitudinal sectional view showing an internal configuration of an image forming apparatus according to the present exemplary embodiment.

Although the present disclosure is described below by way of exemplary embodiments and specific examples thereof with reference to the drawings, the present disclosure is not limited to these exemplary embodiments and specific examples.

It should be noted that, in the following description using the drawings, the drawings are schematic and the ratio of dimensions and the like may be different from the actual value and that members not necessary for the description may be omitted from the drawings for easy understanding.

In the drawings, in order to facilitate understanding of the following description, the left-right direction of an image forming apparatus 1 is defined as the X-axis direction, the depth direction thereof is defined as the Y-axis direction, and the up-down direction thereof is defined as the Z-axis direction.

(1) Overall Configuration and Operation of Image Forming Apparatus

FIG. 1 is a schematic longitudinal sectional view showing an internal configuration of the image forming apparatus 1 according to the present exemplary embodiment.

An overall configuration and operation of the image forming apparatus 1 will be described below with reference to the drawings.

The image forming apparatus 1 includes a control device 10, a sheet transport device 20, an image forming unit 100 in which a photoconductor unit 30 and a developing device 40 are integrated, a toner cartridge 50, an exposure device 60, a transfer device 70, and a fixing device 80.

The control device 10 includes an image forming apparatus control unit 11 for controlling the operation of the image forming apparatus 1, a controller unit 12 for preparing image data according to a print processing request, an exposure control unit 13 for controlling lighting of a light source of the exposure device 60, a power supply device (not shown), and the like. The power supply device applies a prescribed voltage to a charging roller 32, a developing roller 42, a transfer roller 71, and the like, which will be described below, and supplies power to the exposure device 60.

The controller unit 12 converts image data input from an image reading device (not shown) or print information input from an external information transmission device (for example, a personal computer) into image information for latent image forming and outputs a drive signal to the exposure control unit 13 at a preset timing. The exposure control unit 13 drives the exposure device 60 to scan the surface of a photoconductor drum 31 with light modulated according to data of an image to be formed.

The exposure device 60 of the present exemplary embodiment includes a light emitting diode (LED) head in which LEDs are linearly disposed.

The sheet transport device 20 is provided at the bottom of the image forming apparatus 1. The sheet transport device 20 includes a sheet cassette 21. Multiple sheets P are stacked on the upper surface of the sheet cassette 21. The sheet P of which width direction position is determined by a restricting plate (not shown) is pulled backward (in the X direction) one by one from the upper side thereof by a sheet drawing unit 22 and then transported to a contact portion of a registration roller pair 24 via a relay roller 23.

The photoconductor unit 30 is provided above the sheet transport device 20 and includes the photoconductor drum 31 that is rotationally driven. The charging roller 32, the developing device 40, the transfer roller 71, and a cleaning blade 34 are disposed along the rotation direction of the photoconductor drum 31. A cleaning roller 33 for cleaning the surface of the charging roller 32 is disposed facing and in contact with the charging roller 32.

The developing device 40 includes a developing housing 41 in which a developer is accommodated. The developing housing 41 is provided therein with the developing roller 42 that is disposed to face the photoconductor drum 31, and a pair of supply auger 43A and stirring auger 43B that is obliquely below a rear surface side of the developing roller 42 and configured to stir and supply the developer to the developing roller 42 side.

Above the developing device 40, a developer accommodating portion 44 in which a developer G is accommodated is disposed. The developer G is separated from the developing housing 41 by a seal member 46 (see FIGS. 2 and 4) and remains in the developer accommodating portion 44 until the developer accommodating portion 44 is mounted to the image forming apparatus 1.

An upper guide chute 45 as an example of a guide member is disposed below the developing housing 41. The upper guide chute 45 guides the sheets P aligned by the registration roller pair 24 to a transfer portion TR.

Above the developing device 40, the toner cartridge 50 is disposed and supported in the image forming unit 100. The toner cartridge 50 accommodates a toner (not shown) therein, and supplies the toner to the developing device 40 as necessary.

The surface of the rotating photoconductor drum 31 is charged by the charging roller 32 and an electrostatic latent image is formed by the exposure device 60. The electrostatic latent image formed on the photoconductor drum 31 is developed as a toner image by the developing roller 42.

The transfer device 70 includes the transfer roller 71 and a transport guide 72. A prescribed transfer voltage is applied to the transfer roller 71 from a power supply device 14 controlled by the image forming apparatus control unit 11. The toner image on the photoconductor drum 31 is transferred onto the sheet P passing through a space between the photoconductor drum 31 and the transfer roller 71.

The residual toner on the surface of the photoconductor drum 31 is removed by the cleaning blade 34 and collected in a waste toner box (not shown). Thereafter, the surface of the photoconductor drum 31 is recharged by the charging roller 32. The residues, which are not removed by the cleaning blade 34 and adhered to the charging roller 32, are captured on the surface of the cleaning roller 33 rotating in contact with the charging roller 32, and then discharged onto the photoconductor drum 31 via the charging roller 32 again.

The fixing device 80 includes a pair of heating module 81 and pressure module 82, and a fixing nip portion (fixing area) is formed at an area where the heating module 81 and the pressure module 82 are in pressure contact with each other.

The sheet P onto which the toner image is transferred by the transfer roller 71 is transported to the fixing device 80 via the transport guide 72 in a state where the toner image is not yet fixed thereto.

The toner image is fixed is to the sheet P transported to the fixing device 80 under the action of heating and press bonding by the pair of heating module 81 and pressure module 82. The sheet P having the toner image fixed thereto is discharged to an ejection tray 1*a* on the image forming apparatus 1 via a discharge roller pair 83.

(2) Configuration of Major Components

Figure 2:
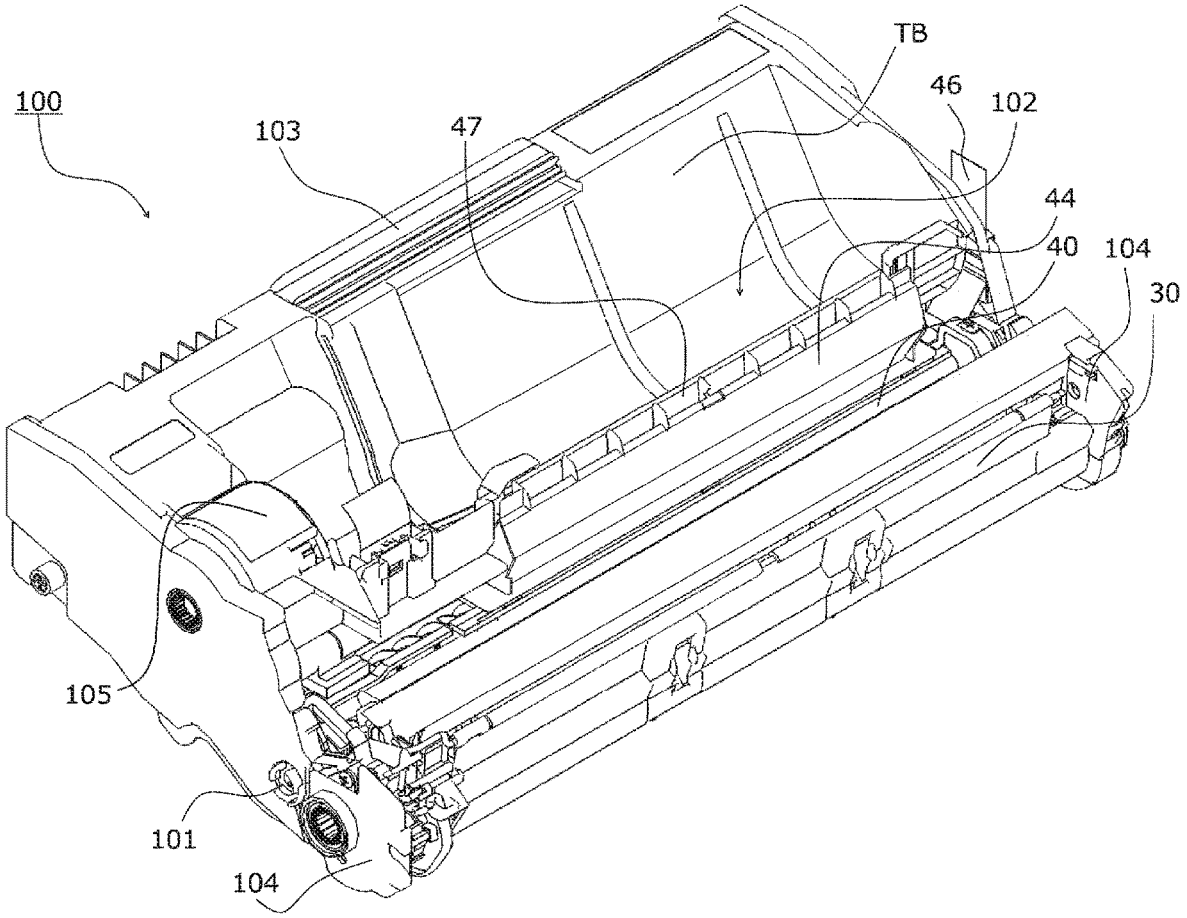
FIG. 2 is a perspective view showing an overall configuration of an image forming unit.
Figure 3:
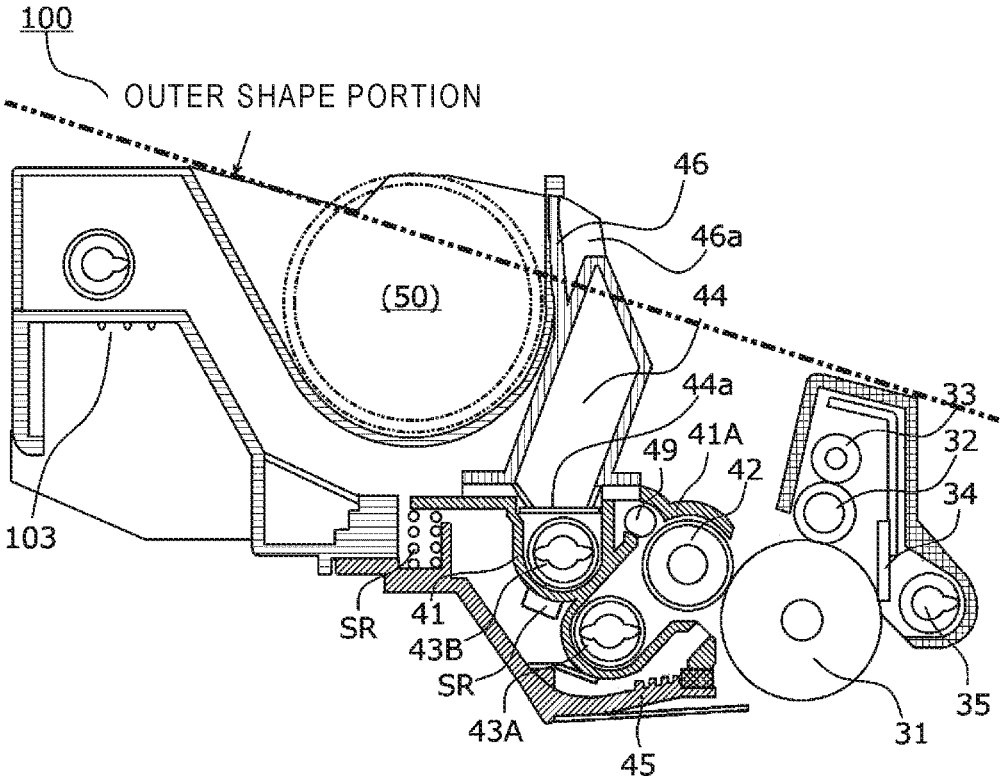
FIG. 3 is a schematic sectional view showing a configuration of the image forming unit.
Figure 4:
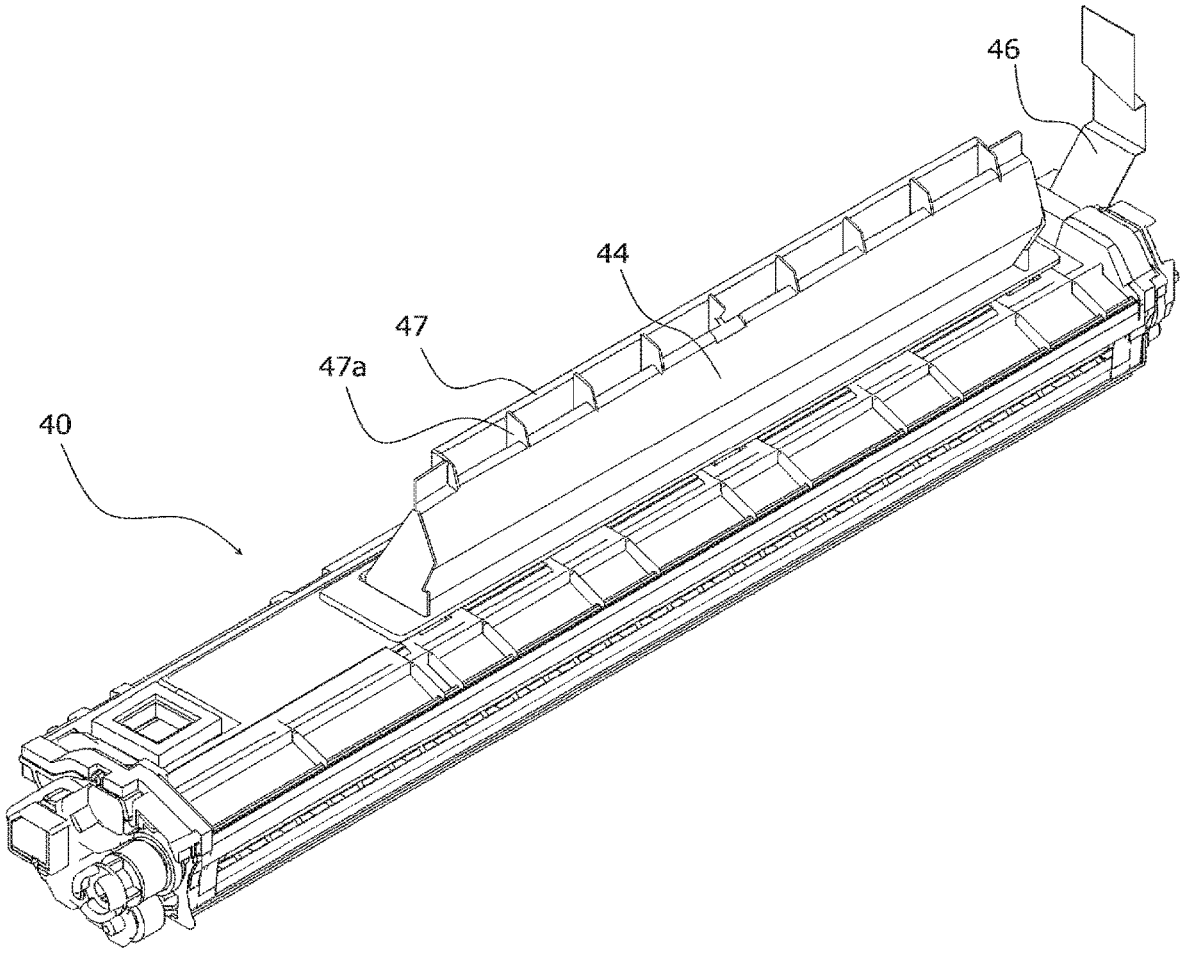
FIG. 4 is a perspective view showing a developer accommodating portion and a restricting portion of a developing device.

FIG. 2 is a perspective view showing an overall configuration of the image forming unit 100. FIG. 3 is a schematic sectional view showing a configuration of the image forming unit 100. FIG. 4 is a perspective view showing the developer accommodating portion 44 and a restricting portion 47 of the developing device 40.

Hereinafter, the configurations of the image forming unit 100 and the developer accommodating portion 44 and the restricting portion 47 in the developing device 40 will be described with reference to the drawings.

(2.1) Overall Configuration of Image Forming Unit

The image forming unit 100 is integrally formed by the photoconductor unit 30, the developing device 40, and a waste toner collecting container TB, and may be attached to or removed from the image forming apparatus 1 by opening or closing an opening/closing door 1*b* (see FIG. 1) of the image forming apparatus 1.

The photoconductor unit 30 and the developing device 40 are connected by a pivot shaft (see FIG. 6) 101 serving as a turning center. The developing housing 41 of the developing device 40 is pressed by a pressing spring S (see FIG. 3), so that the developing roller 42 turns around the pivot shaft 101 serving as a turning center and comes into contact with the photoconductor drum 31 via an abutment bearing (not shown) with a prescribed distance maintained.

When in use, the toner cartridge 50 is mounted to an upper concave portion 102 of the image forming unit 100, and the toner to be mixed with the developer G is supplied into the developing housing 41 of the developing device 40 by a toner supply mechanism 105.

The residual toner on the photoconductor drum 31 removed by the cleaning blade 34 is transported and collected into the waste toner collecting container TB by a transport auger 35 and a transport coil auger (not shown).

(2.2) Configuration of Photoconductor Unit

The photoconductor drum 31 is rotatably supported by an image forming unit housing 104, and the charging roller 32, the cleaning roller 33, the cleaning blade 34, and the transport auger 35, which transports the toner removed by the cleaning blade 34 to the waste toner collecting container TB, are disposed as a unit with respect to the photoconductor drum 31 in the photoconductor unit 30.

As described above, when holding the developer G with a prescribed toner concentration, the developing roller 42 of the developing device 40 turns and comes into contact with the photoconductor drum 31 with the prescribed distance maintained. In this way, the electrostatic latent image formed on the photoconductor drum 31 is developed with the toner.

(2.3) Configuration of Developing Device

In the developing device 40, the developing roller 42 is rotatably supported by the developing housing 41, and the supply auger 43A supplying the developer G to the developing roller 42 while rotating and the stirring auger 43B rotating to stir and transport the developer G to one end of supply auger 43A are disposed within the developing housing 41.

The developer G mixed with the toner supplied from the toner cartridge 50 is stirred by the stirring auger 43B, transported from a back side (IN side: Y direction) to a front side (OUT side: −Y direction), and is moved to the supply auger 43A on the front side (OUT side: −Y direction). Then, the developer G supplied from the supply auger 43A is supplied to the developing roller 42.

An ATC sensor SR for measuring the ratio (TC value) of the toner to the carrier of the developer G circulating in the developing housing 41 is disposed in the developing device 40. The image forming apparatus 1 maintains the TC value of the developer G at a prescribed value by the image forming apparatus control unit 11 instructing toner replenishment from the toner cartridge 50 on the basis of the value measured by the ATC sensor SR.

The developer G supplied from the developer accommodating portion 44 is filled around the supply auger 43A and the stirring auger 43B in the developing housing 41, and the developing housing 41 is blocked by a cover member 41A.

A layer regulating member 49 is disposed above the supply auger 43A and close to the developing roller 42, and regulates the thickness of the developer G adhered to the developing roller 42 by a magnetic force.

The developer accommodating portion 44 is disposed above the stirring auger 43B of the developing housing 41. The developer accommodating portion 44 is a hollow member that has an opening 44*a* at one end, that projects toward the upper side (Z direction) of the image forming unit 100, and that extends in the width direction (Y direction) of the developing housing 41. When not in use, the opening 44*a* is sealed by the extractable seal member 46 in a state where the developer accommodating portion 44 accommodates a prescribed amount of the developer G therein.

In the upper side (Z direction) of the developer accommodating portion 44, the restricting portion 47 protruding upward with respect to the developer accommodating portion 44 is provided integrally with the developer accommodating portion 44. The restricting portion 47 is formed to protrude further to the outside than an outer shape portion (indicated by a two-dot chain line in FIG. 3) of the image forming unit 100, and the protruding portion is reinforced with plural ribs 47*a*.

As shown in FIG. 4, the restricting portion 47 is provided to extend in the width direction (Y direction) of the developer accommodating portion 44 conforming with the developer accommodating portion 44, and both end portions thereof are integrally formed with the developer accommodating portion 44 by side walls 47*b* so as to cover the entire cross-section thereof.

(3) Operation of Restricting Portion

Figure 5:
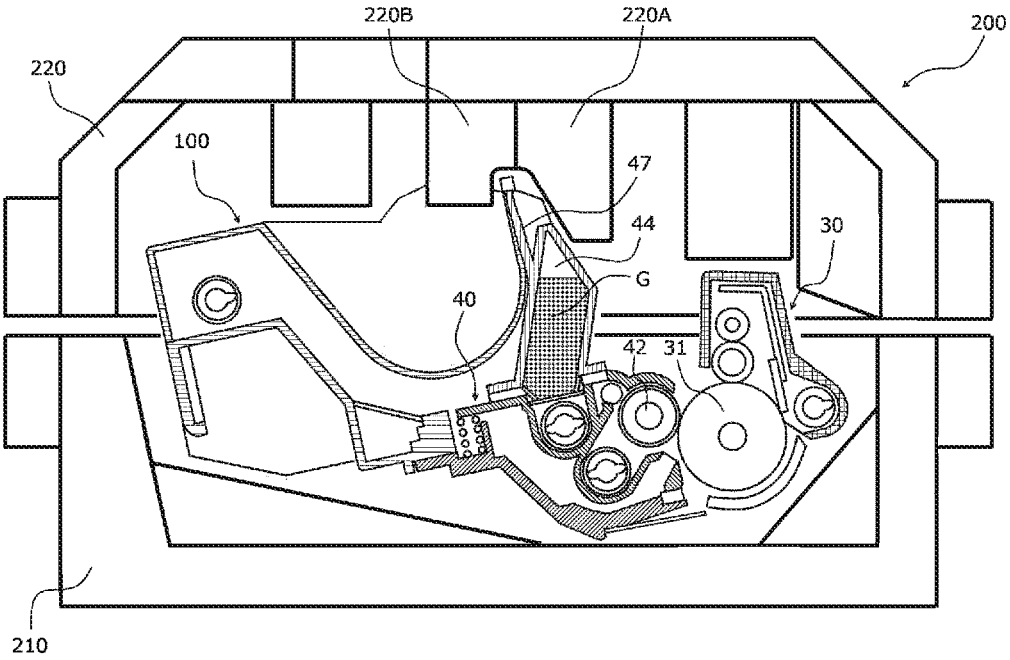
FIG. 5 is a schematic sectional view showing the image forming unit accommodated in a packing material.
Figure 6:
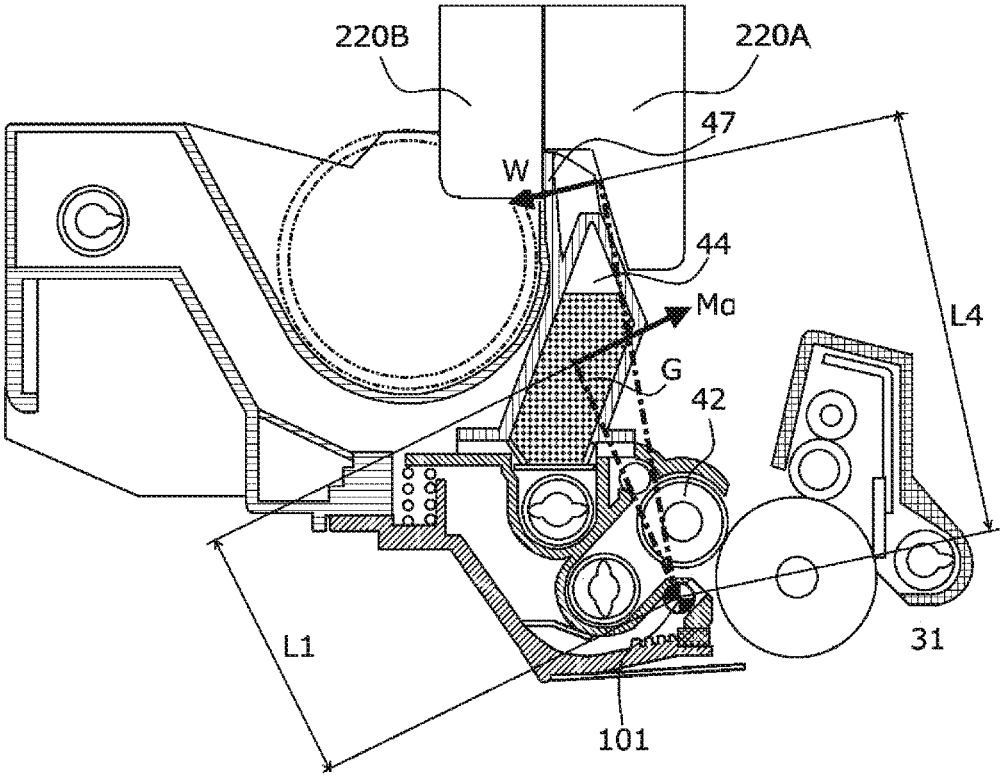
FIG. 6 is a schematic sectional view illustrating contact between the restricting portion and the packing material.
Figure 7:
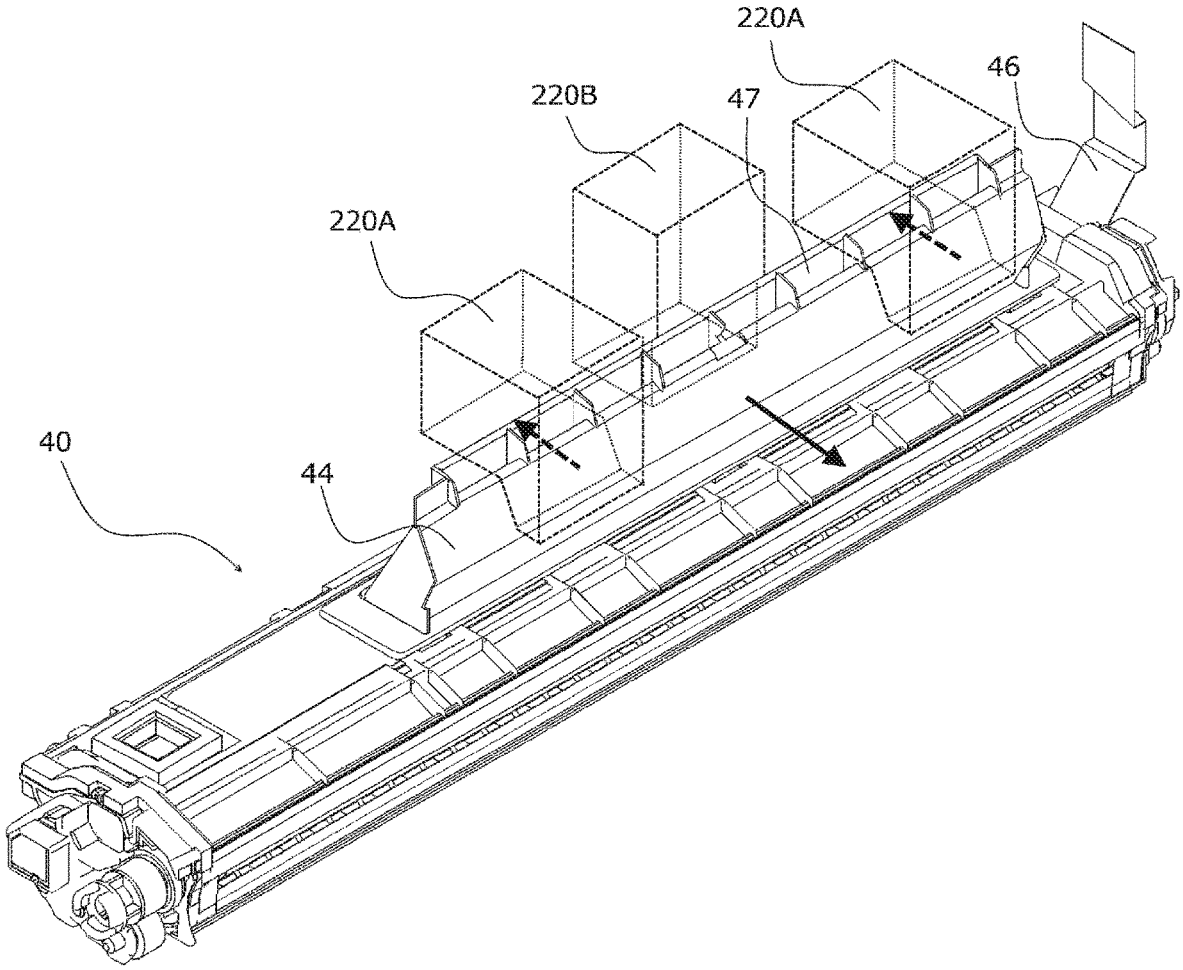
FIG. 7 is a perspective view illustrating contact between the restricting portion and the packing material in a width direction.
Figure 8:
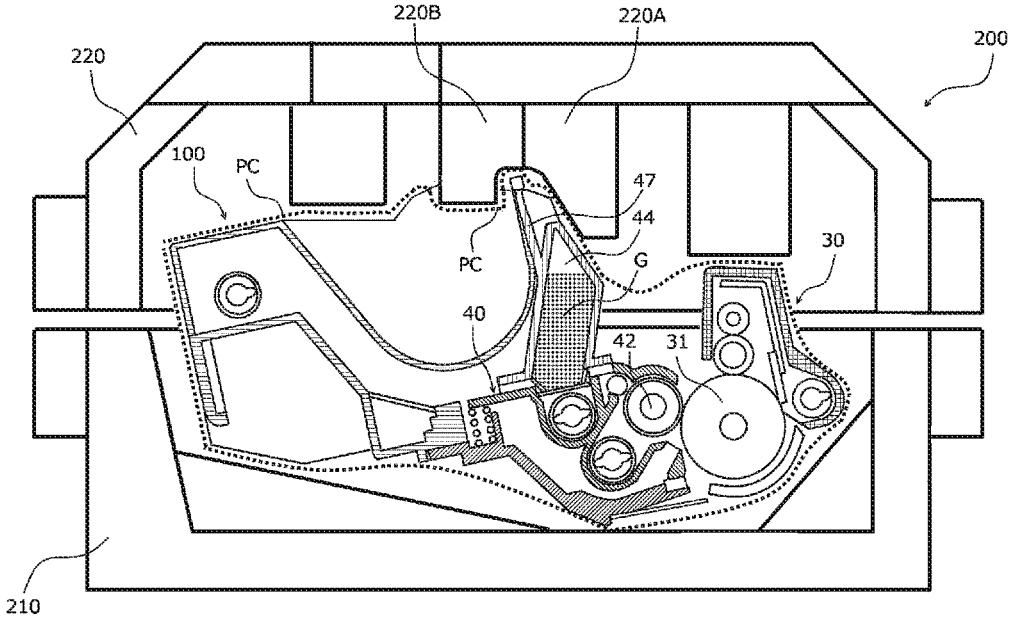
FIG. 8 is a schematic sectional view showing the image forming unit sealed in a bag and accommodated in the packing material.
Figure 9:
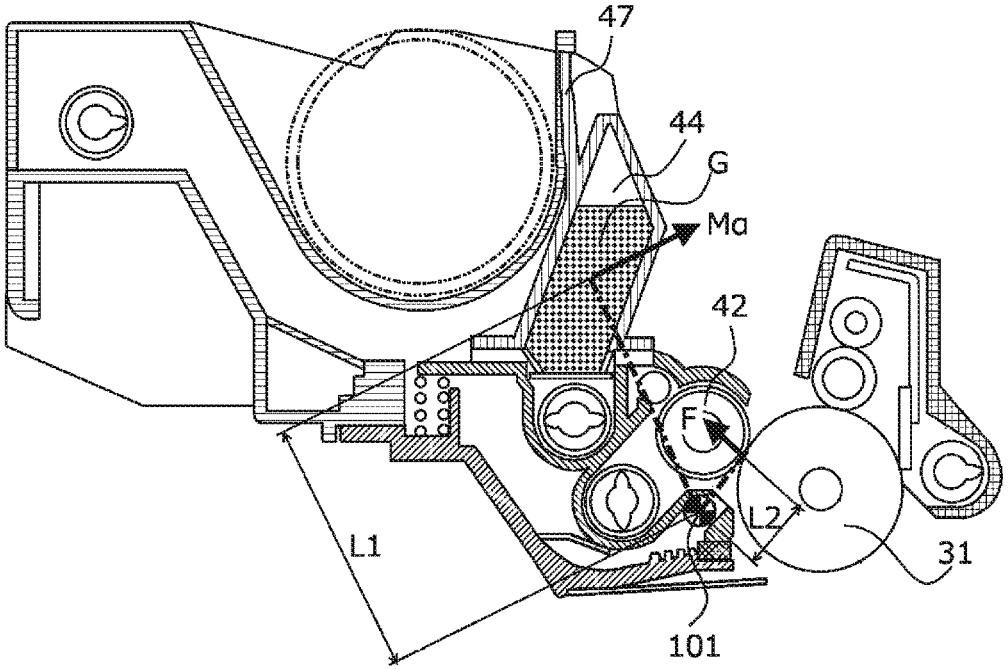
FIG. 9 is a schematic sectional view illustrating a moment around a pivot shaft in the image forming unit.
Figure 10:
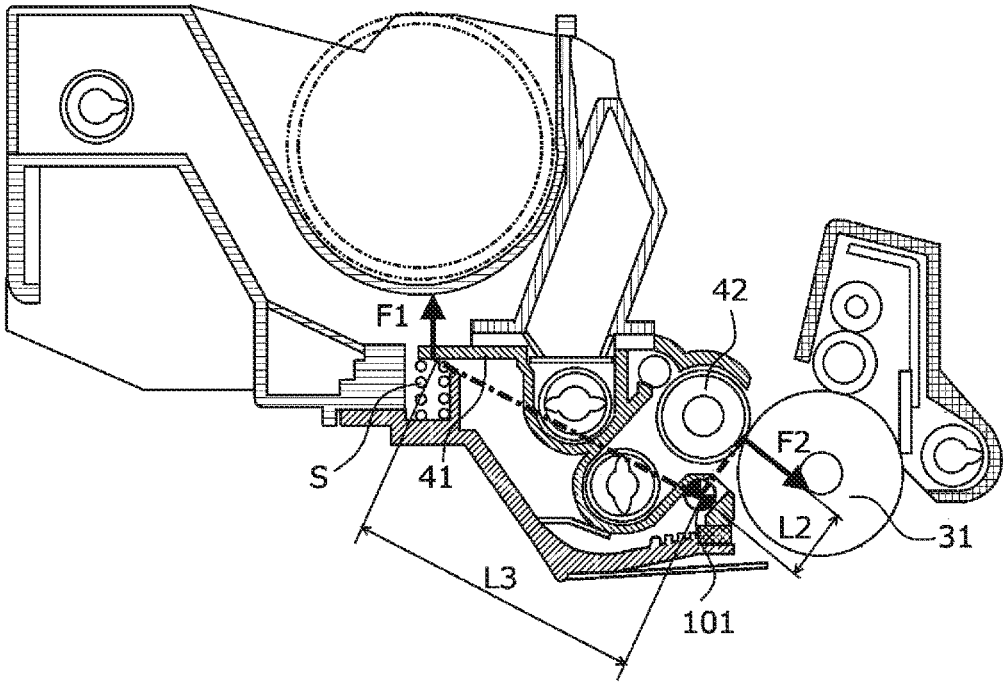
FIG. 10 is a schematic sectional view illustrating a moment around the pivot shaft in the image forming unit when a developing roller comes into contact with a photoconductor drum.

FIG. 5 is a schematic sectional view of the image forming unit 100 accommodated in a packing material 200. FIG. 6 is a schematic sectional view illustrating contact between the restricting portion 47 and the packing material 200. FIG. 7 is a perspective view illustrating the contact between the restricting portion 47 and the packing material 200 in the width direction. FIG. 8 is a schematic sectional view showing the image forming unit 100 sealed in a bag and accommodated in the packing material 200. FIG. 9 is a schematic sectional view illustrating a moment around the pivot shaft 101 in the image forming unit 100. FIG. 10 is a schematic sectional view illustrating a moment around the pivot shaft 101 in the image forming unit 100 when the developing roller 42 abuts against the photoconductor drum 31.

The operation of the restricting portion 47 will be described below with reference to the drawings.

In the image forming unit 100 in which the photoconductor unit 30 and the developing device 40 are integrally formed, the developing housing 41 is pressed by the pressing spring S at a position (−X direction) away from the pivot shaft 101 serving as the turning center, so that the developing roller 42 rotates around the pivot shaft 101 and abuts against the photoconductor drum 31 at a prescribed load.

As shown in FIG. 10, a distance L2 from the pivot shaft 101 to a position where the developing roller 42 abuts against the photoconductor drum 31 is shorter than a distance L3 from the pivot shaft 101 to a position where the pressing spring S presses the developing housing 41, and a moment acts on the developing roller 42, which generates a load F2 making the developing roller 42 capable of stably abutting against the photoconductor drum 31 with a prescribed pressing force F1 of the pressing spring S.

FIG. 9 shows a situation where the load acts on the photoconductor drum 31 against which the developing roller 42 abuts when an external force acts on the developer accommodating portion 44 with the pivot shaft 101 as the turning center.

In such a developing device 40, when not in use, the developer accommodating portion 44 accommodating the developer G is disposed above the developing housing 41, and when in use, the seal member 46 is pulled out and the developer G is supplied into the developing housing 41.

Therefore, in the developing device 40, the center of gravity of the developer G having a constant weight when not in use is at a position that is at a substantially central portion of the developer accommodating portion 44 and that is a distance L1 from the pivot shaft 101. As shown in FIG. 9, the distance L1 is longer than the distance L2 from the pivot shaft 101 to the position where the developing roller 42 abuts against the photoconductor drum 31. Therefore, there is a concern that when an external force acts on the developer G from the outside, a large moment (the weight M of the developer) is generated around the pivot shaft 101, and a large load acts on the photoconductor drum 31 at the position where the developing roller 42 abuts against the photoconductor drum 31 (a reaction force F is generated on the developing roller 42).

In the transport of the image forming unit 100, the external force is applied from the outside to the developer G accommodated in the developer accommodating portion 44 due to dropping or vibration. As shown in the example of FIG. 5, the image forming unit 100 is accommodated in the packing material 200 as an example of a cushion member and transported. As shown in FIG. 5, the packing material 200 includes a lower packing material 210 that immovably holds the entire image forming unit 100, and an upper packing material 220 that immovably holds the upper part of the image forming unit 100.

The upper packing material 220 includes pressing portions 220A and 220B that are formed to protrude toward the inner side (−Z direction). The restricting portion 47 is placed between the pressing portions 220A and 220B at front and rear positions (X direction) so that the upper packing material 220 receives and absorbs the external force acting on the restriction portion 47.

In the image forming unit 100 according to the present exemplary embodiment, as shown in FIG. 6, the restricting portion 47 integrally formed above the developer accommodating portion 44 is provided at a position where the distance L4 from the pivot shaft 101 to the restricting portion 47 is longer than the distance L1 from the pivot shaft 101 to the center of gravity of the developer G in the developer accommodating portion 44 when viewed from the pivot shaft 101 of the developing device 40.

Accordingly, when an external force acts on the developer G accommodated in the developer accommodating portion 44, pressing portions 220A and 220B of the upper packing material 220, which hold the restricting portion 47 between them and come into contact with the restricting portion 47, absorb the external force Mα acting on the developer G with a lower reaction force W.

The restricting portion 47 is formed integrally with the developer accommodating portion 44 so as to extend in the width direction (Y direction) of the developer accommodating portion 44, that is, so as to extend in the axial direction of the pivot shaft 101. Therefore, as shown in FIG. 7, by disposing plural (two in the front-rear direction in the present exemplary embodiment) pressing portions 220A of the packing material 200 on the front side (X direction) with respect to the rear side (−X direction) of the rotation direction with the pivot shaft 101 as the turning center, more surfaces of the restricting portion 47 are in contact with in the front side (X direction), which is the rotation direction of the developing device 40. Accordingly, the load applied to the photoconductor drum 31 can be further reduced when there is a dropping impact.

In transport, as shown in FIG. 8, the image forming unit 100 according to the present exemplary embodiment is placed in a bag-like aluminum pack PC stuck with activated carbon (not shown) as an example of a bag body and is sealed by vacuuming the aluminum pack PC. In the storage of the image forming unit 100, moisture resistance and light shielding properties are required, and mechanical strength is also required depending on the presence or absence and weight of protrusions. The bag body that satisfies the moisture resistance, the light shielding property, and the mechanical strength may be made of, for example, a metal material such as aluminum, and a laminate thereof.

In the image forming unit 100 which is vacuum-sealed, since the restricting portion 47 integrally provided above the developer accommodating portion 44 is formed to protrude further to the outside than the outer shape portion (indicated by the two-dots chain line in FIG. 3) of the image forming unit 100, even in the state of being packaged by the aluminum pack PC, as shown in FIG. 8, the restricting portion 47 still protrudes outside the image forming unit 100.

As shown in FIG. 8, the image forming unit 100 sealed in the aluminum pack PC is wrapped using the packing material 200 as an example of the cushion member, so that the image forming unit 100 is entirely accommodated in the packing material 200. In addition, the restricting portion 47 is placed between the pressing portions 220A and 220B, which formed to protrude to the inside of the upper packing material 220, at front and rear positions (X direction) so that the packing material 200 receives and absorbs the external force acting on the restricting portion 47.

As described above, in the image forming unit 100 in which the photoconductor unit 30 and the developing device 40 are integrally formed so as to be able to rotate around the pivot shaft 101, by providing the restricting portion 47 disposed on the outermost portion of the developing device 40 and in contact with the cushion member to restrict the rotation of the developing device 40 around the pivot shaft 101, the external force acting on the developer accommodating portion 44 when there is a dropping impact can be absorbed and the load applied to the photoconductor drum 31 can be reduced.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming unit contained in a flexible bag and held to allow a cushion member to absorb shock, the image forming unit comprising:

an image carrier on which an electrostatic latent image is configured to be formed;

a developing device including a developing unit configured to develop the electrostatic latent image by turning around a turning center and contacting the image carrier;

a developer accommodating portion that accommodates a developer for use in the developing device; and a restricting portion that is provided on an outermost portion of the developing device, wherein the restricting portion is configured to contact the cushion material so that rotation of the developing device is restricted to maintain contact between a developing roller of the developing device and the image carrier; and wherein the restricting portion is configured to protrude into the cushion member.

2. The image forming unit according to claim 1, wherein the restricting portion is provided at one outer end of the developer accommodating portion so as to be located at an outer side of the developing device farthest from the turning center.

3. The image forming unit according to claim 1, wherein the restricting portion is provided at one outer end of the developer accommodating portion so as to be located at an outer side of the developing device farthest from the turning center in such a manner that a moment acting on the restricting portion from the cushion member around the turning center is greater than a moment acting on the image carrier from the developing unit around the turning center.

4. The image forming unit according to claim 1, wherein the restricting portion is provided at one outer end of the developer accommodating portion so as to protrude outside the image forming unit when the image forming unit is packed in the bag and the bag is vacuum-sealed.

5. The image forming unit according to claim 1, wherein the restricting portion is provided at one outer end of the developer accommodating portion so as to be located between portions of the cushion member at front and rear positions in a direction of turning of the developing device around the turning center and so as to come into contact with the cushion member.

6. The image forming unit according to claim 5, wherein the restricting portion is provided at one outer end of the developer accommodating portion so as to extend in an axial direction of the turning center so that the restricting portion has more faces to come into contact with the cushion member at the front position in the turning direction than at the rear position.

7. An image forming unit comprising:

a photoconductor drum;

a developing housing surrounding a developing roller configured to develop an electrostatic latent image formed on the photoconductor drum by rotating around a pivot shaft to contact the photoconductor drum;

a container configured to contain developer for use with the developing roller; and a protrusion on an outermost portion of the developing housing;

wherein the protrusion is configured to contact a cushion so that rotation of the developing housing is restricted to maintain contact between the developing roller and the photoconductor drum, wherein the image forming unit is configured to be contained in a flexible bag, and wherein the protrusion is configured to protrude into the cushion.

8. The image forming unit according to claim 1, wherein the developing unit is configured to develop the electrostatic latent image by turning around the turning center in a forward turning direction, and wherein the restricting portion is configured to contact the cushion material so that rotation of the developing device is restricted in both the forward turning direction and a backward turning direction that is opposite to the forward turning direction.

9. The image forming unit according to claim 1, wherein the restricting portion is provided at a position where a distance L4 from the turning center to the restricting portion is longer than a distance L1 from the turning center to the center of gravity G of the developer when viewed from the turning center.

* * * * *